US008813758B2

(12) United States Patent
Braveman

(10) Patent No.: US 8,813,758 B2
(45) Date of Patent: Aug. 26, 2014

(54) SMOKING OR VAPORIZING IMPLEMENT

(76) Inventor: Jonathan S Braveman, Scottsdale, CA (US)

( * ) Notice: Subject to any disclaimer, the term of this patent is extended or adjusted under 35 U.S.C. 154(b) by 800 days.

(21) Appl. No.: 12/951,046

(22) Filed: Nov. 21, 2010

(65) Prior Publication Data

US 2012/0125350 A1 May 24, 2012

(51) Int. Cl.
*A24F 47/00* (2006.01)

(52) U.S. Cl.
USPC ..... 131/202; 131/226

(58) Field of Classification Search
CPC ..... A24F 5/00; A24F 47/00; A24F 2700/04
See application file for complete search history.

(56) References Cited

U.S. PATENT DOCUMENTS

| | | | | |
|---|---|---|---|---|
| 2,708,593 | A * | 5/1955 | Benoist | 294/50.7 |
| 6,601,586 | B2 * | 8/2003 | Herrick | 131/191 |
| 2005/0028369 | A1 * | 2/2005 | Cocchiarella et al. | 30/29.5 |

* cited by examiner

*Primary Examiner* — Michael J Felton
(74) *Attorney, Agent, or Firm* — Andra M. Vaccaro, Esq.

(57) ABSTRACT

The present invention is a combined smoking/vaporizing, grinding and storage implement used for inhaling burning or vaporized herb, tobacco or other plant material. The implement has an end around which serrated saw like teeth are located. The serrated teeth are bent slightly inward. When the implement is placed in a container of herb, tobacco or other plant material and is torqued, the teeth grind it into smaller pieces that are caught within the teeth such that the ground material eventually can fill up a compartment located within the implement and are enclosed therein by the teeth. An alternate embodiment further comprises a filter on the inhalation end for filtering the smoke or vapor caused by the burning or vaporizing of the ground material.

11 Claims, 1 Drawing Sheet

SMOKING OR VAPORIZING IMPLEMENT

FIELD OF THE INVENTION

The present invention generally relates to smoking or vaporizing implements in which ground material is burned or vaporized and then inhaled by the user. More specifically, the present invention is drawn to a smoking or vaporizing implement having a grinder at one end which permits easy and efficient grinding of herb, tobacco and other related materials and a second end which provides a filter such that when the implement is used, it purifies the smoke emanating therefrom.

BACKGROUND OF THE INVENTION

Prior art smoking and/or vaporizing implements usually require that the tobacco, herb or other plant material be ground up and then placed therein by hand. In many instances, the user first grinds the material and then packs it into the smoking or vaporizing apparatus. This procedure is messy and often results in lost material, especially if the apparatus is small.

One prior art device disclosed in U.S. Pat. No. 6,601,586 (Henner) comprises a tube-shaped member having multiple, evenly spaced slots around the peripheral edge of one end extending parallel with the longitudinal axis, which create a plurality of teeth for cutting tobacco. The problem with this device is that because the teeth are parallel with said longitudinal axis and are substantially rectangular in shape and have gaps in between the teeth, they do not contain the smoking material within the device when it is in use. Likewise, there is no means for filtering the smoke or vapor emanating therefrom while the device is in use.

SUMMARY OF THE PREFERRED EMBODIMENTS

One preferred embodiment of the present invention is a combined smoking/vaporizing, grinding and storage apparatus comprising a first opening therein at a first end extending to a second opening located elsewhere in the apparatus. In a preferred embodiment, the apparatus is cannular with the first opening extending from the first end to an opening in the second end. A preferred embodiment further comprises a chamber into which the smoking material is placed for smoking, vaporizing or storage. The chamber is either externally connected to the second opening or located therein.

The apparatus of a preferred embodiment can be any shape so long as there is at least one channel therein connecting the chamber to the first end. In a preferred embodiment, the chamber is located within the second end of the cannular member and has a larger diameter than the opening to which the chamber is connected. In a preferred embodiment which is not cannular, the chamber has a cross section that is larger than the opening therein which connects it to the first end. In a preferred embodiment, the chamber is comprised of a first end and a second end. The first end of the chamber is connected to the channel. The second end comprises an opening having an outer rim with a serrated edge that bends slightly inward so as to slightly enclose the interior of the chamber.

In a preferred embodiment, the serrated edge is comprised of a plurality of substantially triangular shaped members that bend slightly inward and have sharp points thereon which are capable of grinding herb, plant matter, tobacco and the like. Due to the slight inward bend of the serrated edge, the ground material will be caught within the chamber. Thus, the device of the present invention is capable of grinding and storing ground material that can later be smoked or vaporized therein. In an alternative preferred embodiment of the present invention, the first end also comprises a filter compartment, into which a filter is placed so that it filters the smoke or vapor flowing through the channel during use. After the filter has been used, it can easily be removed and replaced. In yet a further alternate embodiment, the filter compartment may comprise the filter itself and can be removed and replaced.

BRIEF DESCRIPTION OF THE DRAWINGS

A detailed description of the invention will be made with reference to the accompanying drawings, where like numerals refer to like parts and in which.

DETAILED DESCRIPTION OF THE PREFERRED EMBODIMENTS

In the following descriptions of the invention, terms such as "top", "bottom," first "end" and "second end", "horizontal", "longitudinal", and the like are used herein merely for ease of description and refer to the orientation of the components shown in the figures and are not meant to limit the invention in any way.

Figure 1:
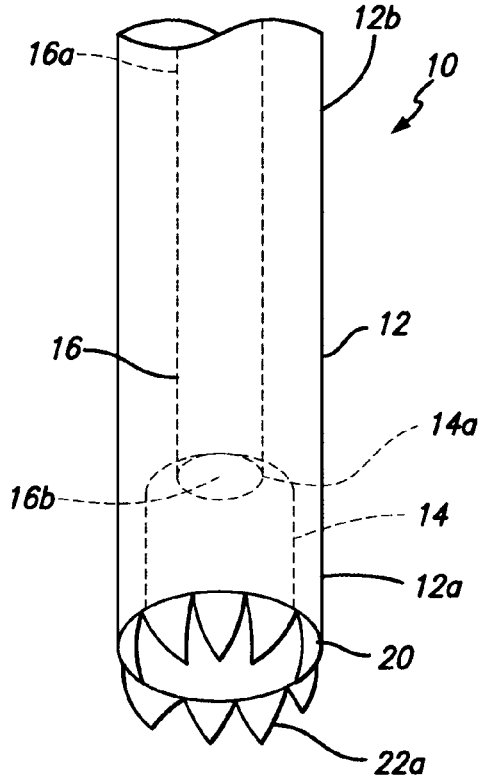
FIG. 1 is a perspective view of a preferred embodiment of the present invention.
Figure 2:
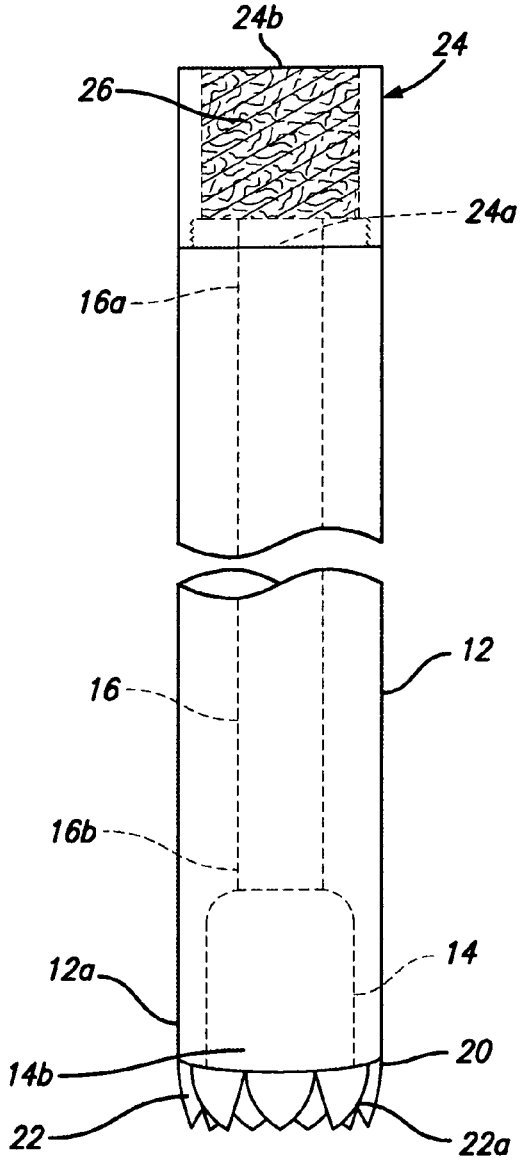
FIG. 2 is a side view of an alternate embodiment of the device of the present invention in which there is a filter compartment.
Figure 3:
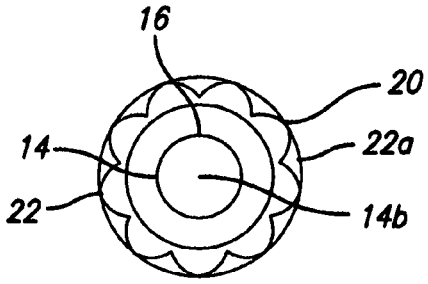
FIG. 3 is an end view of the serrated edge of a preferred embodiment of the present invention.

Generally, the present invention may be briefly described as follows. Referring first to FIGS. 1 and 2, the device 10 of the present invention is shown. The device 10 comprises a member 12 having a first end 12*a* and a second end 12*b*. The first end 12*a* is connected to the second end 12*b* through a channel 16 that extends between end 12*a* and end 12*b*. The first end 16*a* of channel 16 comprises an opening that extends through the first end 12*a* and the second end 16*b* of channel 16 comprises an opening that extends through the second end 12*b* of member 12. Immediately adjacent to the second end 16*b* of channel 16 is a chamber 14 that, in a preferred embodiment is fabricated so that it has a greater cross section than the opening of channel 16. In an alternate embodiment, the chamber 14 and the channel 16 have the same cross sectional area.

In a preferred embodiment, chamber 14 is a concavity formed within first end 12*a* having an opening 14*a* which connects the chamber 14 with the channel 16. In an alternate embodiment, chamber 14 could be fabricated separately and placed within the concavity formed within first end 12*a* with suitable modifications.

In a preferred embodiment member 12 is cannular, however, member 12 may be can be any shape so long as there is a channel 16 therein connecting the opening 14*a* in the chamber 14 to the opening at the second end 16*b* of channel 16. Chamber 14 has an outer opening 14*b*, which in the preferred embodiment is larger than the opening at the second end 16*b* of channel 16.

In a preferred embodiment chamber 14 is substantially bowl shaped. However, in an alternate embodiment, chamber 14 may be any shape so long as it has a rim 20. Rim 20 is comprised of a serrated edge 22. In a preferred embodiment, serrated edge 22 is comprised of a plurality of substantially triangular-shaped teeth 22*a* which extend from the outside of chamber 14 so that they bend at a slight inward angle, so that they partially enclose the outside opening of chamber 14. In a preferred embodiment in which member 12 is cannular, teeth

22*a* are equal in size and dimension. In an alternate preferred embodiment, teeth 22*a* are trapezoidally shaped.

In a preferred embodiment, the thickness of the teeth 22*a* is gradually and slightly reduced towards the narrower ends of the teeth. Because the teeth 22*a* are saw shaped and bend inward at a very slight inward angle, they resemble claws. Teeth 22*a* are capable of grinding material that is external to the device 10 and then enclosing the ground material within the chamber 14. Specifically, when the teeth 22*a* are placed within a container of herb, plant matter, tobacco or other smoking or vaporizing material and torqued within that material in a clockwise or counterclockwise or combination fashion, the teeth 22*a* grind the material into smaller pieces. As the material is being ground, due to the configuration of the teeth 22*a* over the chamber, material is forced upward into the chamber 14. This process continues until the chamber 14 is as full as the user would like.

In an alternate preferred embodiment such as shown in FIG. 2, member 12 further comprises a second chamber 24. Second chamber 24 has a first opening 24*a* that is connected to the first end 16*a* of channel 16. Second chamber 24 has a second opening 24*b* through which the smoke or vapor is inhaled when the apparatus of the present invention is being used.

In a preferred embodiment, member 12 had threads thereon at second end 12*b* and second chamber 24 has threads thereon at first opening 24*a* such that second chamber 24 can be tightly screwed onto member 12. However, any means to tightly but removable connect second chamber 24 to member 12 may be used such as, by way of illustration and not limitation, male and female connectors, reusable epoxies, slots, hinges, etc.

In an alternate preferred embodiment, second chamber 24 contains a removable filter 26. Filter 26 may be comprised of cotton, charcoal, crepe paper, cellulose, cellulose acetate or any other material that can reduce the amount of tar, and fine particles inhaled during the combustion of material in the first chamber a cigarette. Filter 26 also reduce the harshness of the smoke and will keep the burning material out of the user's mouth. In another alternate embodiment, second chamber 24 may contain flavor packets in lieu of or in addition to the filters or the filters may be flavored so that the smoke or vapor being inhaled by the user is flavored.

In a preferred embodiment, member 12 of the present invention may be uniformly hollow from end to end to create a tube-like structure extending from the first end to the second end, while in other preferred embodiments, member 12 may have other chambers of various sizes interconnected so that smoke can flow throughout in substantially a direct flow. Regardless of the external design, each of the embodiments of the invention allow for a clear path of smoke or vapor when it is in use.

The presently disclosed embodiments are to be considered in all respects as illustrative and not restrictive, the scope of the invention being indicated by the appended claims, rather than the foregoing description, and all changes which come within the meaning and range of equivalency of the claims are therefore intended to be embraced therein. The embodiments and methods described above are exemplary embodiments of the present invention. Those skilled in the art may now make numerous uses of, and departures from, the above-described embodiments without departing from the inventive concepts disclosed herein. Thus, the construction of the embodiments disclosed herein are not limitations of the invention. Accordingly, the present invention is to be defined solely by the scope of the following claims.

The invention claimed is:

1. An implement for smoking or vaporizing a material through inhalation, comprising:

a first member having a first end opening and a second end opening, a channel connecting the first end opening of the first member with the second end opening, a first chamber having a first opening and a second opening having a rim, the rim comprising a plurality of saw-like teeth which are slightly angled over the first chamber and the first opening of the first chamber connected to first end opening of the channel, and a second chamber having a first opening and a second opening, the first opening connected to the channel and the second opening being accessible to the user of the implement such that while the material is either burned or vaporized, the user will be able to inhale smoke or vapor thereto, wherein the second chamber is removably connected to the first member wherein the second chamber contains filtering material.

2. The implement of claim 1, wherein the filtering material is removable and replaceable.

3. The implement of claim 1 wherein the first chamber is removable and replaceable.

4. The implement of claim 1, wherein the saw-like teeth are capable of grinding herb, tobacco or other plant material by torquing the teeth in a container thereof, such that upon grinding, the herb, tobacco or other plant material will be enclosed in the first chamber.

5. The implement of claim 1, wherein the saw-like teeth gradually taper in thickness towards their points.

6. An implement for smoking or vaporizing a material through inhalation, comprising:

a first member having a first end opening and a second end opening, a channel connecting the first end opening of the first member with the second end opening, a first chamber contained within the first end of the first member, wherein the first chamber comprises a first opening and a second opening having a rim, the rim comprising a plurality of saw-like teeth which are slightly angled over the first chamber and the first opening of the first chamber connected to first end opening of the channel, and a second chamber having a first opening and a second opening, the first opening connected to the channel and the second opening being accessible to the user of the implement such that while the material is either burned or vaporized, the user will be able to inhale smoke or vapor therefrom, wherein the second chamber contains filtering material.

7. The implement of claim 6, wherein the filtering material is removable and replaceable.

8. The implement of claim 6 wherein the first chamber is removable and replaceable.

9. The implement of claim 6, wherein said first member is cannular.

10. The implement of claim 6, wherein the saw-like teeth are capable of grinding herb, tobacco or other plant material by torquing the teeth in a container thereof, such that upon grinding, the herb, tobacco or other plant material will be enclosed in the first chamber.

11. The implement of claim 6, wherein the saw-like teeth gradually taper in thickness towards their points.

* * * * *